United States Patent [19]

Sorelle

[11] 4,450,499

[45] May 22, 1984

[54] FLARE IGNITION SYSTEM

[76] Inventor: Roland R. Sorelle, 812 Standifer Rd., Elk City, Okla. 73644

[21] Appl. No.: 332,666

[22] Filed: Dec. 21, 1981

[51] Int. Cl.[3] ..... F23Q 3/00

[52] U.S. Cl. ..... 361/253; 431/264

[58] Field of Search ..... 431/24, 127, 73, 74, 431/202, 264–266, 80; 361/253, 256, 257, 263; 315/209 T, 209 M, 209 R, 119, 225

[56] References Cited

U.S. PATENT DOCUMENTS 3,142,332 7/1964 Weber et al. ..... 361/256 X 3,411,036 11/1968 Casey ..... 315/119 X 4,147,493 4/1979 Straitz ..... 431/264 X

*Primary Examiner*—Samuel Scott

*Assistant Examiner*—Kenichi Okuno

*Attorney, Agent, or Firm*—Robert M. Hessin

[57] ABSTRACT

A flare ignition system for oil well flaring of combustible gases which includes a central control unit, low voltage interconnect line and plural remote igniter units which include alternate first and second spark gaps coordinated in fail-safe operation. Coordination is carried out by pulse counting and validating circuitry which assures that one of the spark gaps will always be ignitable or alarm condition will exist.

9 Claims, 3 Drawing Figures

FLARE IGNITION SYSTEM

BACKGROUND OF THE INVENTION

1. Field of the Invention

The invention relates generally to an automatic ignition system for combustible gas and, more particularly, but not by way of limitation, it relates to an improved system for insuring proper ignition of flared gases vented into the atmosphere.

2. Description of the Prior Art

The prior art includes numerous ignition devices for use in igniting flared combustible gases, and such systems take the form of a remote actuating device and some form of sparking device in the ignition area. Some prior devices, especially those that are presently used on flare lines in and around oil well drilling rigs, utilize a 110 volt power input which must be led across the drill site to a high voltage transformer which, in turn, must supply the sparking voltage to such as a spark plug for ignition of the combustible gas.

U.S. Pat. No. 4,147,493 in the name of Straitz is of general interest in that it describes an igniter comprising spark electrodes and a control apparatus positioned at a position remote from the ignition position. Such general approach with remote actuation is also taught in U.S. Pat. No. 4,147,498 in the name of Clarke. This patent teaches another form of system wherein a control box is remotely located at the bottom of an ignition stack as leadup wires are utilized to energize a pair of igniters. This circuit utilizes flare stack ignition by means of SCR power control which receives input of standard line A-C voltage.

SUMMARY OF THE INVENTION

The present invention relates to a fail-safe type of dual igniter system which is capable of functioning at reduced voltage requirement to perform a repetitive spark actuation at a combustible gas release point adjacent to a conventional oil well drilling rig, flare stack or the like. A monitor and control unit is located at a central control position, e.g., at the drilling rig, and is energized by standard A-C line input to provide a low voltage D-C for distribution and energization of the control electronics and the spark unit. The spark unit is located at a position several hundred feet from the rig floor at the gas combustion point, and the low voltage power line is supplied to a selected one of two igniters in the spark unit, a primary igniter and an alternate igniter. The control unit then functions under a free running oscillatory sequence to initiate periodic sparking of the primary igniter with enablement of the alternate igniter upon a predetermined count of successive ignition failures in the primary igniter.

Therefore, it is an object of the present invention to provide a more reliable flare igniter system which utilizes redundancy of power supply lines and igniters.

It is also an object of the invention to provide a low voltage igniter system which avoids the practice of laying 110 volt A-C power lines around an oil well drilling site.

It is also an object of the invention to provide an ignition system which can be powered from a line source or alternative low voltage source, such as a manual generator, battery or solar source.

It is yet another object of the present invention to provide a flare ignition system which can be continually monitored at the rig floor for proper operation and presence of spark at the flare point.

Finally, it is an object of the invention to provide an electronic automatic ignition device of low cost and high reliability which functions to assure continual proper flare ignition of combustible gases from the drilling system mud line flare point.

Other objects and advantages of the invention will be evident from the following detailed description when read in conjunction with the accompanying drawings which illustrate the invention.

DETAILED DESCRIPTION OF THE INVENTION

Figure 1:
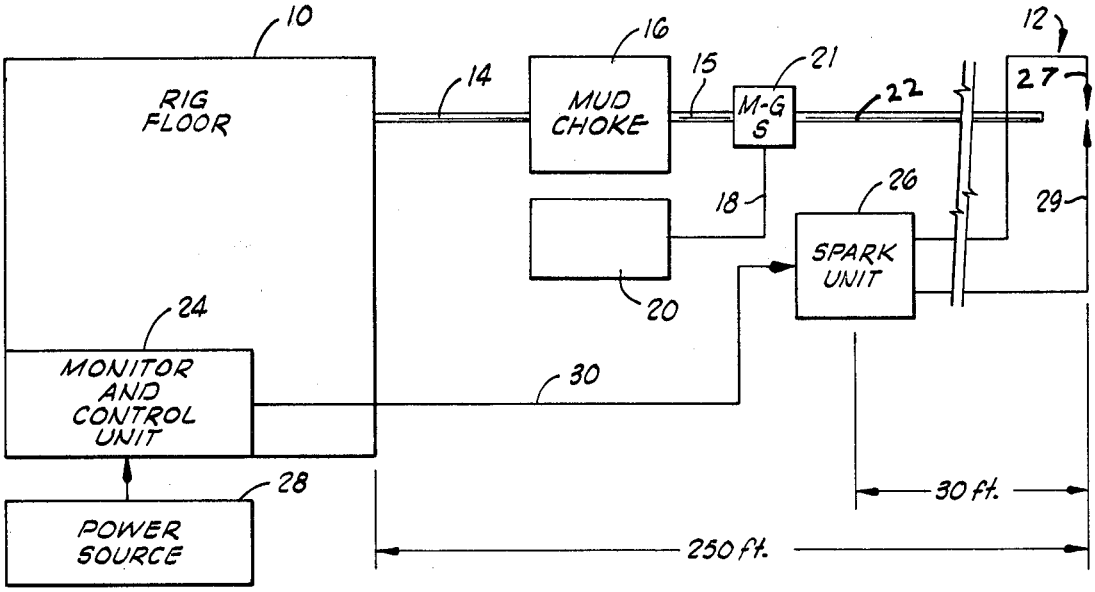
FIG. 1 is a block diagram of the ignition system of the present invention in relation to the oil well drilling rig and associated mud line.

FIG. 1 illustrates a well drilling layout that may be encountered in the oil field wherein a drilling rig floor 10 is disposed in coactive association with the drilling fluid or mud circulation lines. In drilling some wells, high concentrations of natural gas are encountered during the drilling procedure and it is desirable and sometimes necessary to flare such gas from the mud circulation line at a preselected flare point 12 which is located a safe distance away from the drilling rig 10, e.g., 250 feet or the like.

The drilling fluid circulating up the borehole annulus is then flowed through a high pressure mud line 14 to the mud choke 16. Mud choke 16 is a conventional oil field equipment which serves to reduce the mud pressure for flow by line 15 to the mud gas separator 21. The mud goes to the pit 20 via line 18 and the gas then goes to the flare point 12 via line 22. The cleaned up mud from mud pits 20 is then routed back to rig floor 10 for entry into the Kelly and recirculation in the wellbore.

The present invention includes a monitor and control unit 24 as located at rig floor 10 interconnected with a spark unit 26 which is located remotely adjacent the flare point 12 but preferably about 30 feet away in order to prevent heat damage during flaring of gas products. Igniter spark gaps 27 and 29 are controlled by the spark unit 26. The monitor and control unit 24 receives primary energizing power input from a suitable power source 28, generally a standard 110 volt A-C line which is available at the rig floor 10. Monitor and control unit 24 is then connected to spark unit 26 by means of a control cable 30.

Figure 2:
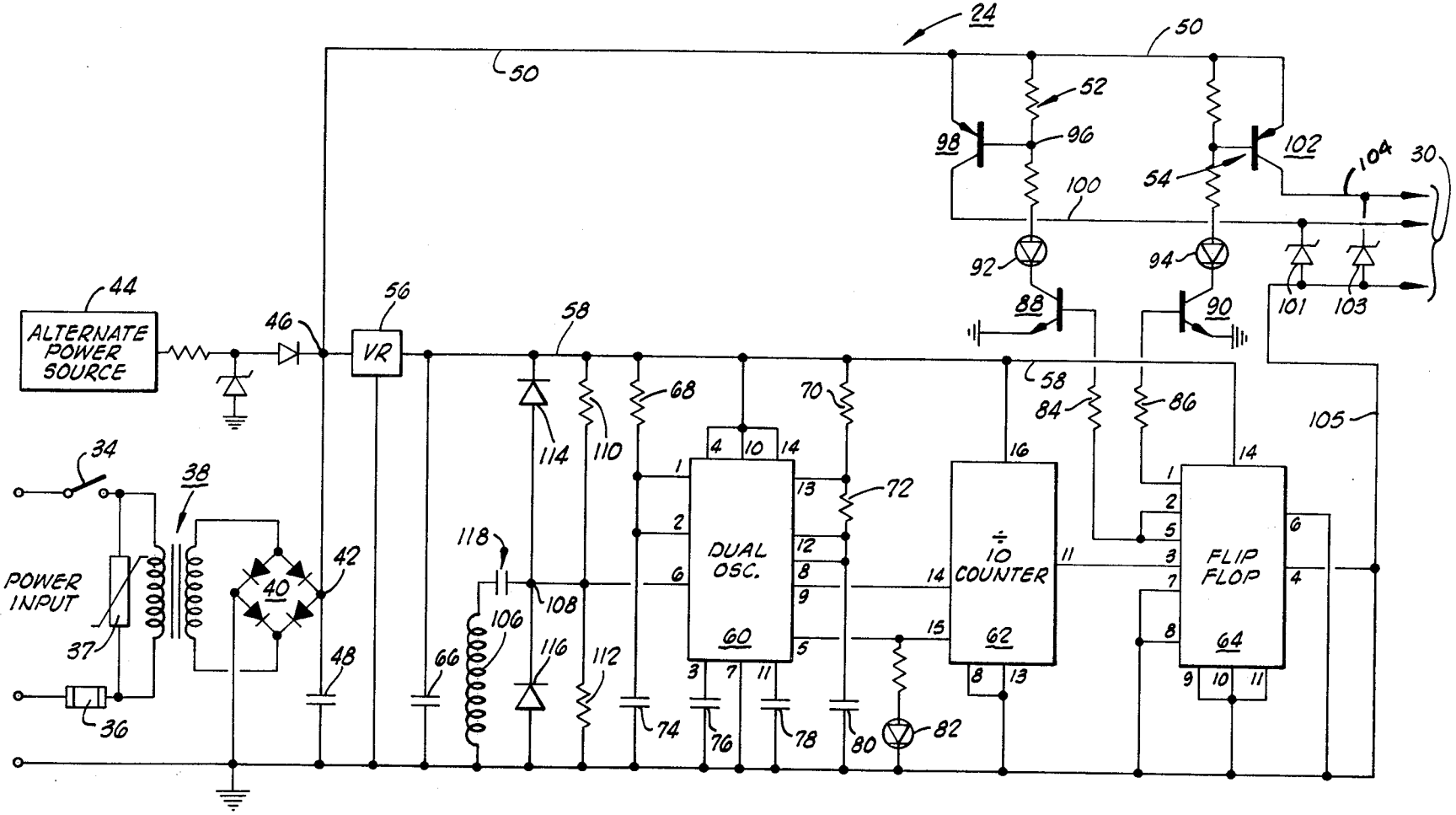
FIG. 2 is a schematic diagram of the monitor and control unit of the present invention.

Referring to FIG. 2, the monitor and control unit 24 receives power from source 28 as input through main power switch 34 and fuse 36 to the primary of a power transformer 38. A varistor 37 across primary of transformer 38 protects against transients such as caused by lightning. The secondary of transformer 38 is then connected across a rectifier bridge 40 connected between ground and plus voltage terminal 42 where a 25 volt D-C unregulated voltage is established. An alternative power source 44, e.g. manual, solar, etc., may also be utilized during primary source failure to establish a D-C operating voltage at terminal 46.

Smoothing capacitor 48 provides filtering of the primary D-C voltage as it is available from terminals 42–46 via lead 50 to the respective solid state switches 52 and 54, as will be further described. The D-C voltage from terminal 46 is also applied to a voltage regulator 56, a 12 volt voltage regulator, IC type LM 340-12, which provides regulated 12 volts D-C on the lead 58 for energization and control of the timing components, i.e., dual oscillator 60, counter 62 and flip flop 64. A smoothing capacitor 66 provides further stablization for the regulated 12 volt supply.

The dual oscillator 60, an IC type LM 556 Dual Multivibrator, is connected to function as both a free running oscillator and a one-shot multivibrator, as will be further described. In its basic mode, oscillator 60 functions as a one Hertz free running oscillator to provide basic circuit timing with pulse output to the divide-by-ten counter 62. Timing frequency is set by the resistance-capacitance values of biasing resistors 70 and 72 and the associated capacitor 80. Capacitors 76 and 78 provide stabilization of the oscillator 60. Pulse output is from pin No. 9 as applied to pin No. 14 of counter 62, an IC type CD 4017 Counter.

The output from pin No. 11 of Counter 62 then provides toggle control of flip flop 64, an IC type CD 4013, which provides alternate control outputs from pin Nos. 2 and 1 through respective resistors 84 and 86 to the base of respective NPN transistors 88 and 90. The transistors 88 and 90 are connected grounded emitter and function alternately through LED diode indicators 92 and 94 to control conduction of the alternate solid state switches 52 and 54, respectively. Thus, with a positive voltage level applied to the base transistor 88, transistor 88 conducts to reduce the voltage at the junction 96 thereby to render PNP transistor 98 conductive to enable the 25 volt D-C voltage on line 100 of control line 30 to the spark unit 26. Alternatively, i.e., in the second mode condition wherein a full ten count toggles flip flop 64, a negative voltage level is supplied to the base of the transistor 88 while a positive voltage level is applied to the base of alternate transistor 90, type NPN, thereby to energize LED indicator 94 and enable type PNP transistor 102 to provide conduction of 25 volts D-C voltage on line 104 of control line 30. The PNP transistors 98 and 102 may be such as type TIP42 while the NPN transistors 88 and 90 may be type 2N2222. Zener diodes 101 and 103 are connected to ground interconnect 105 to protect the monitor and control unit 24 from damaging voltage transients on lines 100 and 104 of control line 30 that might be caused by an occurence such as lightning.

Detection coil 106 is connected between ground and capacitor 118. Capacitor 118 is connected to the trigger input (pin 6) of dual oscillator 60. Diodes 116 and 114 clamp pin 6 protecting the trigger input from excessive voltages. Bias resistors 110 and 112 hold pin 6 above the threshold point to trigger the one shot multivibrator comprising one-half of dual oscillator 60. Pin 6 of oscillator 60 is normally above the threshold point, however a spark produced by either of the igniters 120 or 122 at their respective spark gaps induces a signal on the control line 30. This signal is received by coil 106 and fed via capacitor 118 to the trigger input 6 of dual oscillator 60. Trigger input 6 is momentarily driven below the threshold point and the one shot multivibrator momentarily changes state providing a positive pulse at its output, pin 5, which resets the counter 62 thereby beginning a new ten count.

The bias at pin 6 can be adjusted by the ratio of resistor 110 to resistor 112. The bias level determines how large the spark gaps 27 and 29 must be before the one shot multivibrator changes state.

Figure 3:
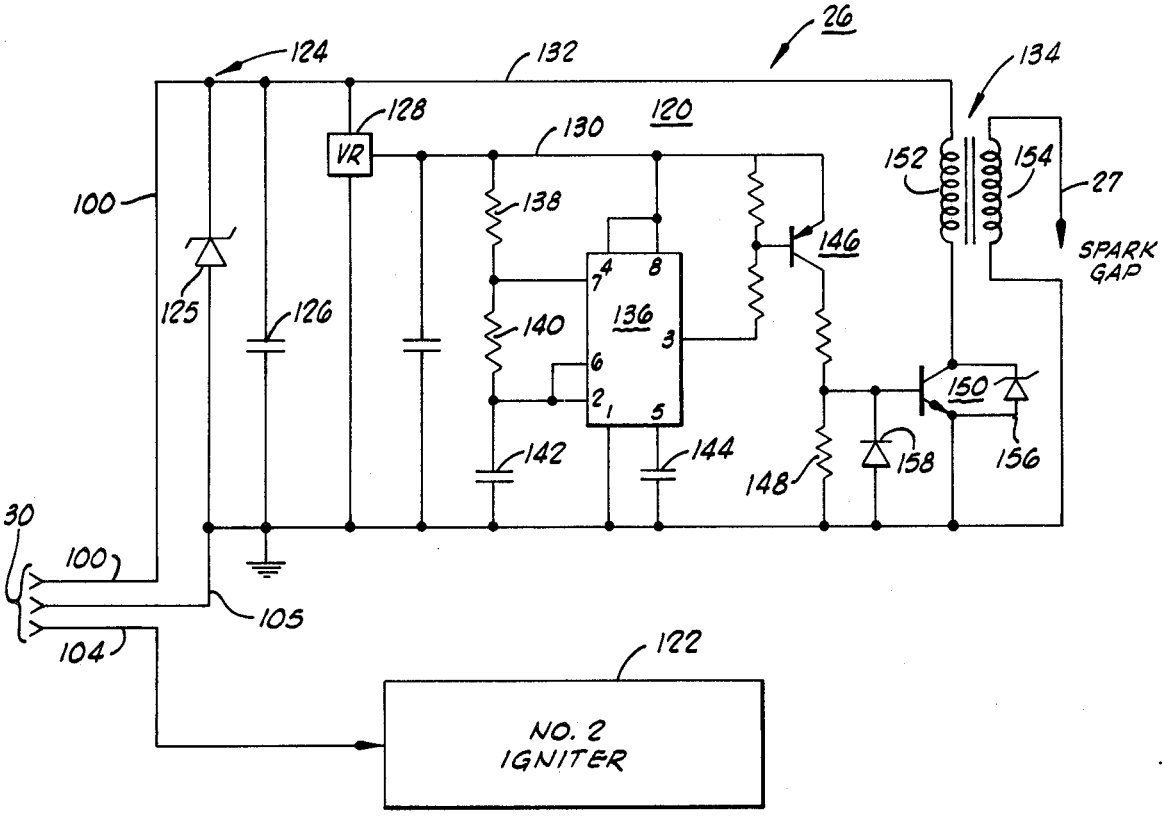
FIG. 3 is a partial schematic block diagram of a spark unit as utilized in the present invention.

FIG. 3 shows the spark unit 26 as it receives input of control lines 100 and 104 to each of separate igniter circuits 120 and 122. The igniter circuits 120 and 122 are identical and description shall proceed with respect to No. 1 igniter 120. When enabled, 25 volt D-C is input via control line 100 to an input terminal 124 which is connected to a grounded filter capacitor 126, a 12 volt regulator 128, an IC Type LM 340 T12, and a zener diode 125. The zener diode 125 acts as a transient suppressor. In the event of a voltage transient, such as might be caused by lightning, appearing on the control line 100, the zener absorbs the transient before the ignitor circuit 26 is damaged by excess voltage. The voltage regulator 128 then provides 12 volt regulated D-C on lead 130 while the input 25 volt D-C is available on lead 132 to the ignition transformer 134.

A multivibrator 136, an IC type LM 555 C, is connected to operate as a free running oscillator having a frequency of one Hertz and providing a switching output for two milliseconds each second to enable the spark process. Free running oscillator 136 includes biasing resistors 138 and 140 and timing capacitor 142 as the output from pin No. 3 for two milliseconds of each cycle places a negative going voltage on the base of a PNP transistor 146, a type TIP 30. As transistor 146 is rendered conductive, voltage dropped across resistor 148 increases the voltage on the base of an NPN transistor 150, type 2SC 1172 B, to enable conduction from lead 132 through primary 152 of transformer 134 to ground for a period of two milliseconds. Upon cessation of conduction of transistors 146 and 150, the collapsing magnetic field induces a high voltage output burst from secondary 154 through the spark gap 27 to ignite any gas present at the flare point 12. The stepped up voltage across spark gap 27 is a high voltage on the order of 25,000 volts. A Zener diode 156 serves as a voltage limitor across transistor 150. The base of transistor 150 is clamped by a diode 158.

In operation, the monitor and control unit 24 is energized and set into operation in order to provide a fail safe method of igniting gas at the flare point. The free running section of oscillator 60 provides a one Hertz output which is supplied to the divide-by-ten counter 62, and flip flop 64 is toggled to its opposite conduction on each ten count. However, during the initial ten count one of the solid state switches, e.g., solid state switch 52, is energized conductive and the 25 volt D-C is present on lead 100 out to the spark unit 26, No. 1 igniter 120. When spark gap 27 fires, the induced signal is applied via coil 106 and capacitor 118 to terminal 108 which is the one shot trigger input of dual oscillator 60. The output is connected to pin No. 15 of divide-by-ten counter 62 thereby to reset the counter and commence the next successive ten count. So long as the No. 1 igniter is firing no ten counts are completed by the counter 62, the system is properly operative and the indicator lights LED 92 and LED 82 so indicate. In the event of a failure of the circuit including solid state switch 52, voltage control line 100 and No. 1 igniter 120, the tenth count from counter 62 toggles flip flop 64 thereby energizing the standby solid state switch 54 to provide the 25 volt D-C output on lead 104 to the No. 2 igniter 122. Indicator lights will signify the altered condition at the rig floor on monitor and control unit 24 so that remedial measures can be taken to reinforce the integrity of the equipment.

The foregoing discloses a novel flare ignition system which performs the critical functions with redundancy and fail-safe interdependency so that rig operator surveillance will yield the required information as to equipment function and reliability. In addition, the system utilizes a low supply voltage, high arc voltage approach which enables distribution lines of low voltage capacity in and around the drilling site thereby to avoid the more dangerous array of A-C power lines which are present around the work area. The detection circuit receives a signal that is directly related to the intensity of the spark at either spark gap. The absence of a spark or a spark whose intensity is below a predetermined level is interpreted as a failure of that igniter. Thus the system truly monitors and indicates the ignition potential (i.e. spark intensity). In the event of a failure or spark that is too small, the alternative igniter is brought into operation to provide fail-safe redundancy.

It should be understood that a variation of operation may provide for automatic energization of control unit 24 in response to detectable gas presence at the flare point 12. It would also be entirely within the teachings of the present invention to utilize a capacitive discharge ignition system at the flare point.

Changes may be made in combination in arrangements as heretofore set forth in the specification and shown in the drawings; it being understood that changes may be made in the embodiments disclosed without departing from the spirit and scope of the invention as defined in the following claims.

What is claimed is:

1. Apparatus for controlled ignition of combustible gases at a designated flare point, comprising:

first and second spark gaps disposed at said flare point;

first and second igniter circuits each connected to a respective one of the first and second spark gaps;

switching means normally operating in a first mode for repetitively energizing the first igniter circuit and first spark gap, and having an alternative second operating mode for energizing the second igniter circuit and second spark gap;

means for sensing the first igniter circuit to generate an ignition control signal upon detection of energization; and pulse generating means responsive to said ignition control signal to generate first and second outputs to said switching means to control selection of respective first and second mode operations.

2. Apparatus as set forth in claim 1 wherein said switching means comprises:

first switch means energized by said first output of said pulse generating means to apply energizing power to said first igniter circuit; and second switch means energized by said second output of said pulse generating means to apply energizing power to said second igniter circuit.

3. Apparatus as set forth in claim 2 wherein each of said first and second switch means comprises:

solid state switch means.

4. Apparatus as set forth in claim 1 wherein said pulse generating means comprises:

oscillator means providing a first mode output in response to said ignition control signal and a second mode output in the absence of the ignition control signal;

counter means reset by said first mode output and energized by said second mode output to provide a count pulse output after a pre-set number of counts; and flip-flop means controlled by said count pulse output to enable a selected one of said first and second mode operations.

5. Apparatus as set forth in claim 4 wherein said switching means comprises:

first switch means energized by said first output of said pulse generating means to apply energizing power to said first igniter circuit; and second switch means energized by said second output of said pulse generating means to apply energizing power to said second igniter circuit.

6. Apparatus as set forth in claim 1 wherein said means for sensing comprises:

detection means sensing spark energization of said first and second igniter circuits and connected as input to said pulse generating means.

7. Apparatus as set forth in claim 1 wherein said first and second igniter circuits each comprise:

a voltage supply lead connected to said switching means;

oscillator means energized by said voltage supply lead to provide periodic pulse output;

inductive means connected to said voltage supply lead and to a respective spark gap; and electronic switch means controlled by said periodic pulse output to enable said inductive means thereby to energize said spark gap.

8. Apparatus as set forth in claim 7 wherein said inductive means comprises:

a transformer having the primary connected to said voltage supply lead and electronic switch means and the secondary connected to said spark gap.

9. Apparatus as set forth in claim 1 which further comprises:

means adjusting the threshold level of said ignition control signal to said pulse generating means to indicate occurrence of greater than a preset spark intensity level.

* * * * *